US006845743B1

(12) United States Patent
Bishop

(10) Patent No.: US 6,845,743 B1
(45) Date of Patent: Jan. 25, 2005

(54) OIL PAN WITH VERTICAL BAFFLES FOR OIL FLOW CONTROL

(75) Inventor: Thomas M. Bishop, Richmond, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/817,082

(22) Filed: Apr. 2, 2004

(51) Int. Cl.[7] ..... F02F 7/00

(52) U.S. Cl. ..... 123/195 C; 123/198 E; 123/196 R; 184/106

(58) Field of Search ..... 123/90.38, 195 C, 123/198 E, 196 R; 184/106

(56) References Cited

U.S. PATENT DOCUMENTS 1,200,172 A * 10/1916 Danver ..... 184/13.1
5,103,782 A * 4/1992 Matsui ..... 123/195 C
5,653,205 A * 8/1997 Ozeki ..... 123/195 C
5,664,537 A * 9/1997 Beranek et al. ..... 123/195 C
5,852,991 A * 12/1998 Yamamura et al. ..... 123/195 C
5,960,763 A 10/1999 Yamamura ..... 123/195 C
6,143,169 A * 11/2000 Lee ..... 210/168
6,340,012 B1 * 1/2002 Yamashita et al. ..... 123/195 C
6,530,354 B1 3/2003 Bishop et al. ..... 123/195 C
6,640,767 B2 * 11/2003 Kato et al. ..... 123/195 C

* cited by examiner

*Primary Examiner*—Weilun Lo
(74) *Attorney, Agent, or Firm*—Karl F. Barr, Jr.

(57) ABSTRACT

An oil pan for an engine includes a body having a floor and side walls. The body has a plurality of baffles extending vertically from the floor and intersecting each other and the side walls in a manner to form four chambers. The baffles have openings to allow oil flow therethrough. One of the chambers acts as an oil pick-up chamber.

20 Claims, 3 Drawing Sheets

OIL PAN WITH VERTICAL BAFFLES FOR OIL FLOW CONTROL

TECHNICAL FIELD

The present invention relates to an oil pan having a plurality of vertical baffles which divide the oil pan into four chambers to limit oil movement during high acceleration vehicle maneuvers.

BACKGROUND OF THE INVENTION

A typical oil pan is disposed beneath a cylinder block and crank shaft of an internal combustion engine. Such an oil pan is configured to receive oil that drains or is otherwise exhausted from the cylinder block and the crank shaft and/or main bearings that support the crank shaft. The oil collects in a sump of the oil pan and is then pumped from a sump pick-up location into a lubrication system associated with the engine. The oil pan may also be provided with a horizontal baffle that inhibits oil from moving away from the pick-up location during high acceleration (i.e., "high G") vehicle maneuvers, such as sudden turning, acceleration, or braking events.

The horizontal baffle may require a two-piece construction of the oil pan. The horizontal baffle is effective in limiting "sloshing" of oil during high acceleration maneuvers, but also delays the return of the oil into the sump for redistribution to the engine. The oil collects on top of the horizontal baffle and can become entrained in the crankshaft windage, which slows the flow of oil draining into the sump after it has been discharged by the engine.

SUMMARY OF THE INVENTION

The present invention provides an improved oil pan which eliminates the need for a horizontal baffle, thereby enabling a one-piece construction and reducing the cost and weight of the oil pan, as well as the quantity of oil required for the engine.

More specifically, the invention provides an oil pan for an engine including a body having a floor and side walls. The body has a plurality of baffles extending vertically from the floor and intersecting each other and the side walls in a manner to form four chambers. The side walls have openings to allow adequate oil flow therethrough between the chambers. One of the chambers acts as an oil pick-up chamber.

Preferably, the body is a one-piece cast aluminum component, and the four chambers include the oil pick-up chamber, a rear chamber, and two side chambers. One of the openings is positioned at a base of one of the baffles to communicate the rear chamber with the oil pick-up chamber, and two more of the openings are positioned at a base of another two of the baffles, respectively, to communicate the two side chambers with the oil pick-up chamber.

The baffles forming the rear chamber are angled with respect to the side walls and with respect to each other to form a funnel shape to direct oil toward the pick-up chamber.

A first of the baffles separates one of the side chambers from the oil pick-up chamber; a second of the baffles separates the other of the side chambers from the oil pick-up chamber; a third of the baffles separates the other of the side chambers from the rear chamber; a fourth of the baffles separates the rear chamber from the oil pick-up chamber; and a fifth of the baffles separates the rear chamber from one of the side chambers. The first, second and fourth baffles are sufficiently tall to prevent a substantial amount of oil from sloshing over the baffles during high acceleration vehicle maneuvers.

The opening in the first baffle is preferably substantially the same size as the opening in the second baffle. The opening in the fourth baffle is preferably smaller than the openings in the first and second baffles.

Another aspect of the invention provides an engine including an engine block having at least one cylinder and a crankshaft. A crankshaft oil deflector is positioned below the crankshaft. An oil pan is connected with the engine block closely adjacent the crankshaft oil deflector. The oil pan has a plurality of vertical baffles dividing the oil pan into four chambers, as described above. The oil pan is characterized by the absence of a horizontal baffle extending over the oil pan.

The above features and other features and advantages of the present invention are readily apparent from the following detailed description of the best mode for carrying out the invention when taken in connection with the accompanying drawings.

DESCRIPTION OF THE PREFERRED EMBODIMENTS

Figure 1:
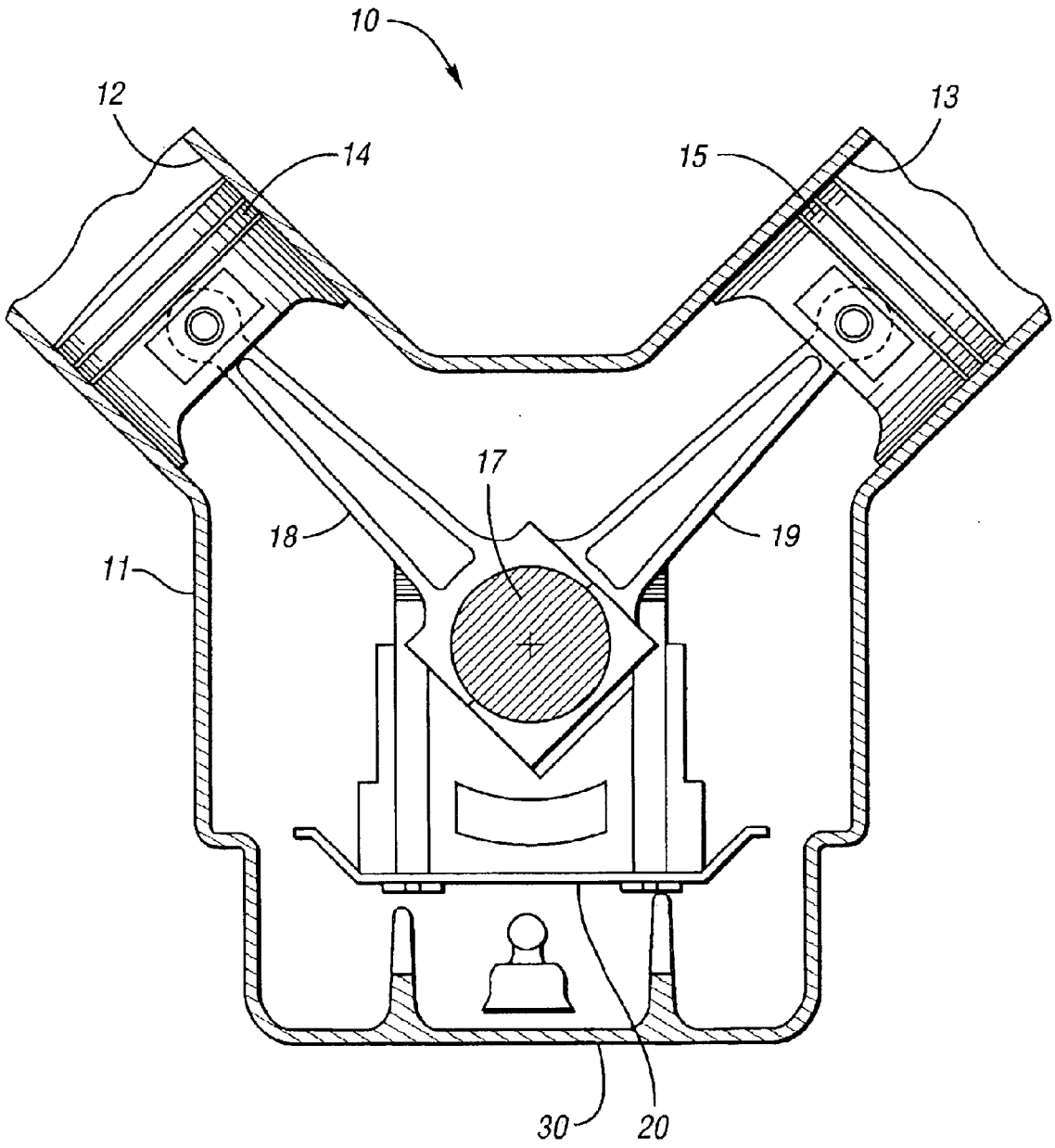
FIG. 1 is a cross sectional view of an engine having an oil pan in accordance with the invention.

FIG. 1 shows an engine 10 including a cylinder block 11 having a plurality of cylinders 12, 13 that house a plurality of pistons 14, 15, respectively. The engine also includes a crankshaft 17 that is connected to the pistons 14, 15 by connecting rods 18, 19, respectively. The crankshaft 17 is rotatable with respect to the cylinder block 11 so as to cause the pistons 14, 15 to reciprocate in the cylinders 12, 13.

Rotation of the crankshaft 17 causes air to rotate with the crankshaft. This rotating air may be referred to as "crankshaft windage." During operation of the engine, some oil that would otherwise drain into the oil pan may instead become entrained in the crankshaft windage. Accordingly, the engine 10 further includes the crankshaft oil deflector 20 which is operative to remove oil from the crankshaft windage and drop the oil into the oil pan 30.

Figure 2:
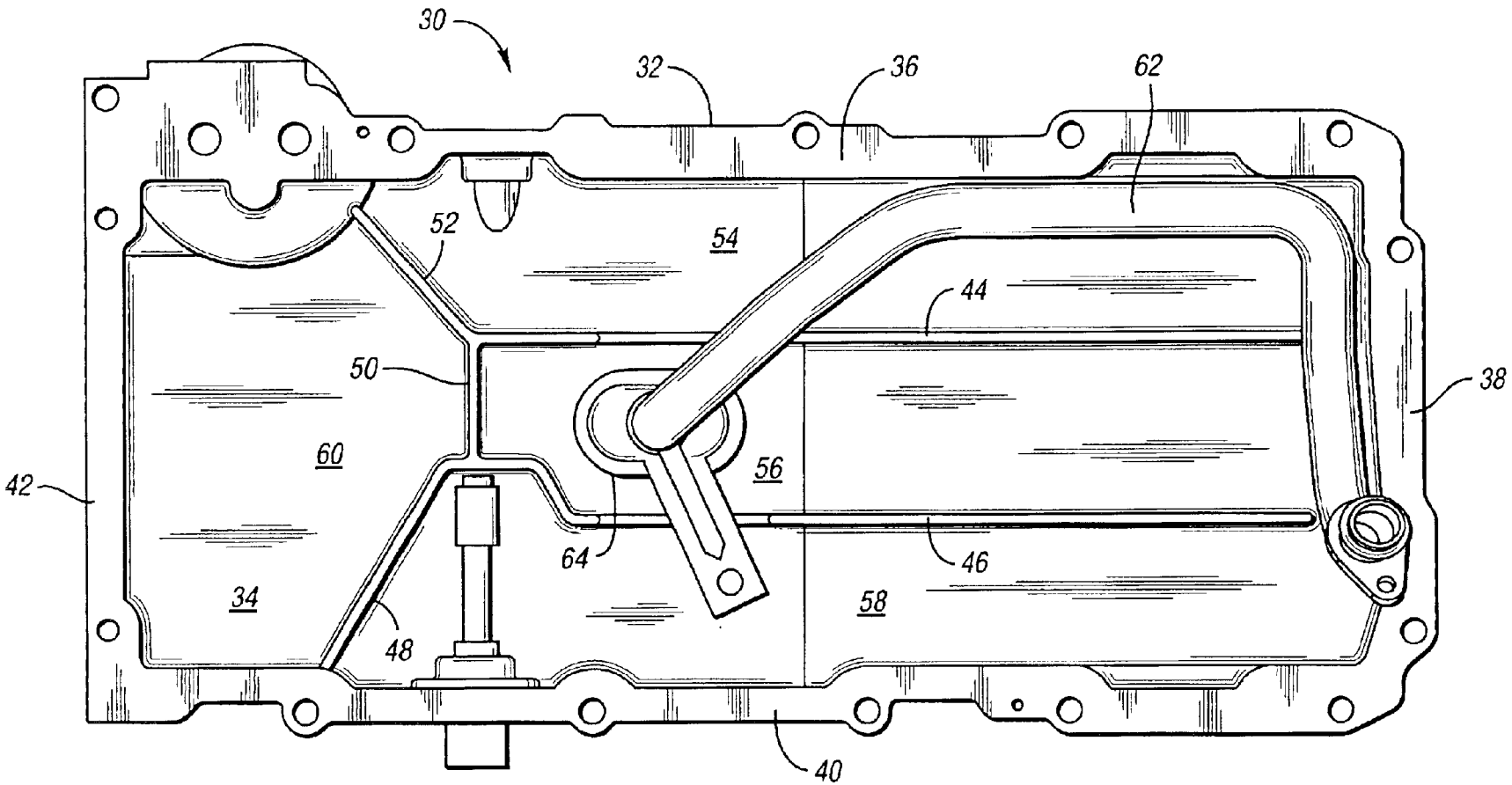
FIG. 2 is a top plan view of an oil pan and pick-up tube corresponding with FIG. 1.
Figure 3:
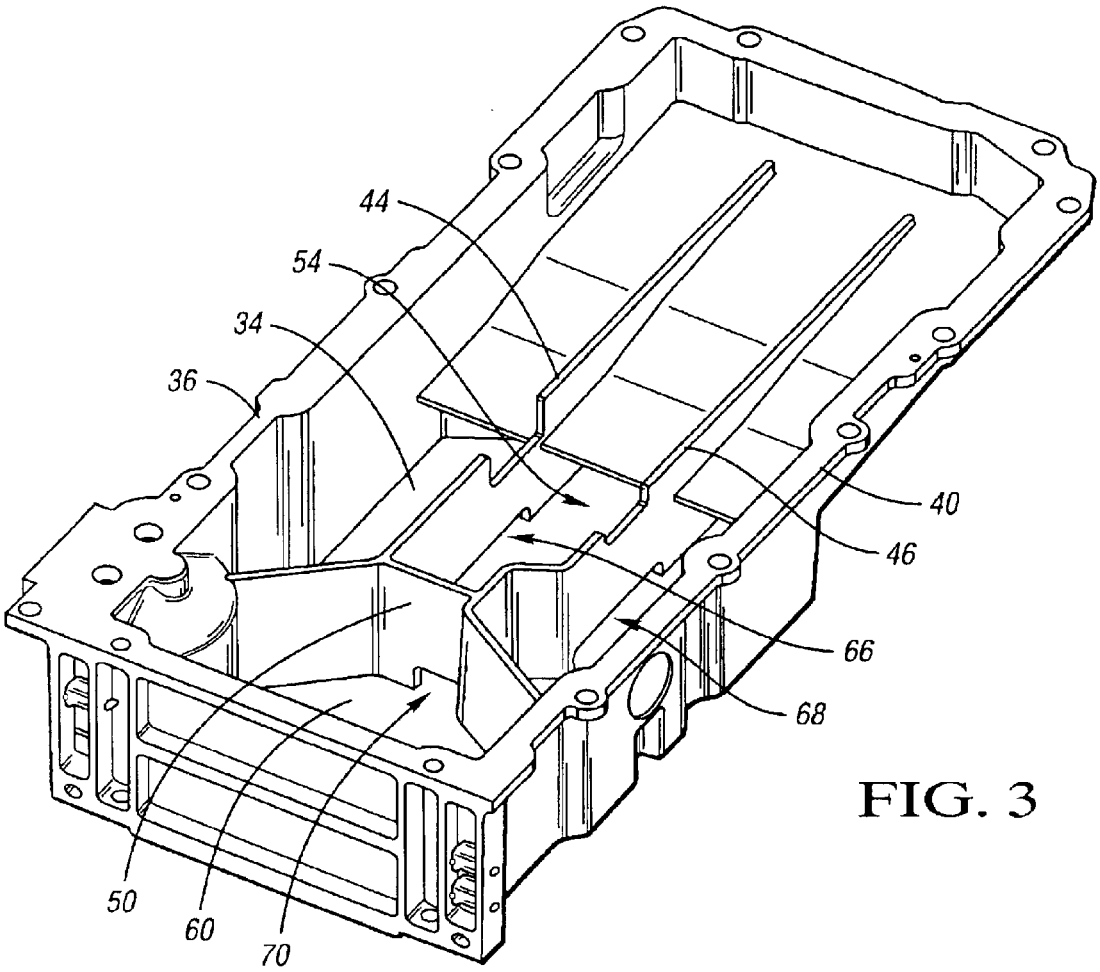
FIG. 3 is a perspective view of the oil pan of FIG. 2.
Figure 4:
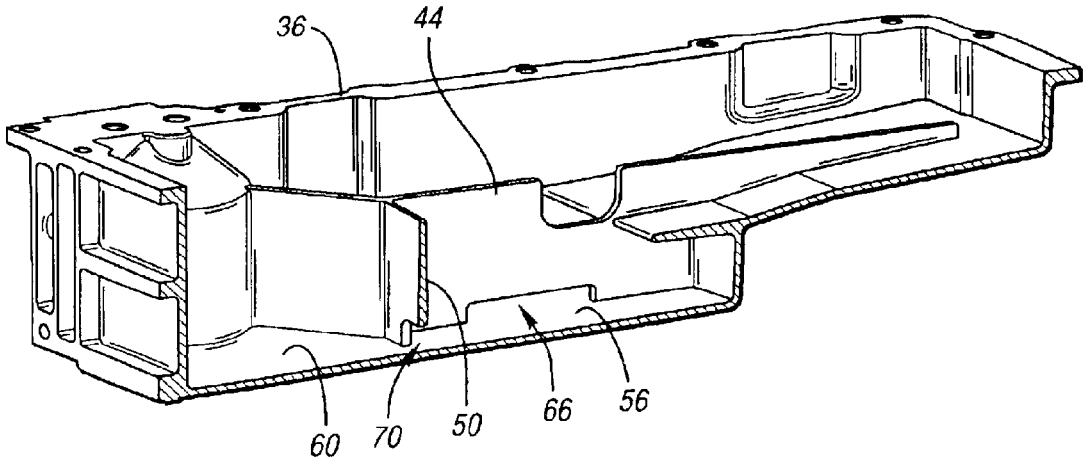
FIG. 4 is a cut away perspective view of the oil pan of FIGS. 2 and 3.

The oil pan 30 is shown in greater detail in FIGS. 2–4. As shown, the oil pan 30 is preferably a one-piece cast aluminum component and includes a body 32 having a floor 34 and side walls 36, 38, 40, 42. The body 32 also includes vertical baffles 44, 46, 48, 50, 52 which divide the oil pan into four chambers, including a left side chamber 54, an oil pick-up chamber 56, a right side chamber 58, and a rear chamber 60. The first baffle 44 separates the left side chamber 54 from the oil pick-up chamber 56. The second baffle 46 separates the oil pick-up chamber 56 from the right side chamber 58. The third baffle 48 separates the rear chamber 60 from the right side chamber 58. The fourth baffle 50 separates the rear chamber 60 from the oil pick-up chamber 56. The fifth baffle 52 separates the rear chamber 60 from the left side chamber 54.

The baffles 44, 46, 48, 50, 52 are sufficiently tall to prevent a substantial amount of oil from sloshing over the baffles during high acceleration vehicle maneuvers. Preferably, the baffles are as tall as possible; i.e., the baffles extend to a position closely adjacent the crankshaft oil deflector 20, as shown in FIG. 1.

As shown in FIG. 2, an oil pick-up tube 62 extends into the oil pick-up chamber 56, and has an oil pick-up head 64 which is positioned approximately 6 millimeters from the floor 34 of the oil pick-up chamber 56 for collecting oil from the oil pick-up chamber 56.

As shown most clearly in FIGS. 3 and 4, the baffles 44, 46, and 50 each include an oil flow opening 66, 68, 70, respectively. As shown, these openings 66, 68, 70 are formed at the base of the respective baffle 44, 46, 50 closely adjacent the floor 34. The openings 66, 68, 70 are sized to allow adequate oil flow between the respective chambers. For instance, in a high acceleration left turn, the oil in the oil pan 30 would be forced toward the side wall 40. However, only a limited amount of oil would exit the oil pick-up chamber 56 through the opening 68. Simultaneously, substantially the same amount of oil would enter the oil pick-up chamber 56 through the opening 66 so that the oil pick-up head 64 of the oil pick-up tube 62 remains submerged in oil. Therefore, the vehicle may maintain such a high acceleration turn for a relatively long period of time. Similarly, in a high G right turn, the oil would be forced toward the left side wall 36, and in this instance, the same amount of oil exiting the oil pick-up chamber 56 through the opening 66 would enter the oil pick-up chamber 56 through the opening 68, thereby assuring that the oil pick-up head 64 remains submerged.

In high G fore/aft acceleration situations (such as sudden turning, acceleration or braking events), the opening 70 in the baffle 50 maintains an adequate amount of oil flow between the oil pick-up chamber 56 and the rear chamber 60. For example, during a high G braking situation, a limited amount of oil flows through the opening 70 from the rear chamber 60 into the oil pick-up chamber 56 to assure that the oil pick-up head 64 remains submerged. As shown most clearly in FIG. 2, the baffles 48, 52 are angled with respect to each other and with respect to the side walls 36, 40 to form a funnel shape to direct the oil toward the opening 70 and into the oil pick-up chamber 56 during such high G braking. Also, during a high G forward acceleration, the opening 70 only allows a limited amount of oil to exit the oil pick-up chamber 56 into the rear chamber 60, thereby assuring that the oil pick-up head 64 remains submerged.

The openings 66, 68 are preferably the same size, and both are greater than the size of the opening 70. However, these openings 66, 68, 70 would be appropriately sized to accommodate the configuration of the oil pick-up head 64.

The openings 66, 68, 70 are sized for optimum performance for all driving conditions and oil viscosities. The openings permit sufficient flow with viscous oil, like that observed during −20° F. cold start, and with less viscous oil, like that observed during race track operation (310+° F.).

Accordingly, when the vehicle experiences high lateral and longitudinal accelerations, the oil flow control openings 66, 68, 70 act to limit the flow of oil away from the oil pick-up screen on the oil pick-up head 64. The resultant performance of the vertical baffles and oil flow control openings is that the oil slosh is controlled and the oil pick-up screen remains submerged under all operating conditions, which allows the engine to operate at high vehicle accelerations for longer periods of time than current production vehicles.

The invention provides several benefits. The engine lubrication system performance is enhanced by the baffles and oil flow control openings. Oil drain back is increased, resulting in less oil starvation. Also, oil aeration and oil temperature is decreased. The bearings also receive more consistent oil pressure. Because oil is eliminated from the crankshaft windage, a gain of approximately two horsepower has been observed with the use of the present invention. The invention also results in significant weight and cost reductions. The one-piece casting reduces design complexity and material compared to other oil pan designs. The gasket and bolts required to complete the two-piece production design are eliminated and the engine is able to operate with one less quart of oil (about 1.82 pounds) than a comparable production design. The weight reduction associated with the use of this invention is estimated to be approximately four pounds (hardware plus one quart less of oil) per engine build. This weight reduction will also improve fuel economy. The cost reduction associated with the use of this invention is significant. By eliminating the horizontal baffle, there is no oil resting on top of such a baffle which may become entrained in the crankshaft windage, and increase engine friction.

While the best mode for carrying out the invention has been described in detail, those familiar with the art to which this invention relates will recognize various alternative designs and embodiments for practicing the invention within the scope of the appended claims.

What is claimed is:

1. An oil pan for an engine comprising:

a body having a floor and side walls; and said body having a plurality of baffles extending vertically from the floor and intersecting each other and the side walls in a manner to form four chambers, and said baffles having openings to allow oil flow therethrough;

wherein one of said chambers acts as an oil pick-up chamber.

2. The oil pan of claim 1, wherein said body is a one-piece cast aluminum component and said four chambers include said oil pick-up chamber, a rear chamber and two side chambers.

3. The oil pan of claim 2, wherein one of said openings is positioned at a base of one of said baffles to communicate said rear chamber with said oil pick-up chamber, and two more of said openings are positioned at a base of another two of said baffles, respectively, to communicate said two side chambers with said oil pick-up chamber.

4. The oil pan of claim 2, wherein said baffles forming said rear chamber are angled with respect to the side walls to form a funnel shape to direct oil toward the pick-up chamber.

5. The oil pan of claim 2, wherein a first of said baffles separates one of said side chambers from the oil pick-up chamber, a second of said baffles separates the other of said side chambers from the oil pick-up chamber, a third of said baffles separates said other of said side chambers from said rear chamber, a fourth of said baffles separates said rear chamber from said oil pick-up chamber, and a fifth of said baffles separates said rear chamber from said one of said side chambers.

6. The oil pan of claim 5, wherein said first, second and fourth baffles each has an opening formed therein to provide limited fluid communication between respective adjacent chambers.

7. The oil pan of claim 5, wherein said first, second and fourth baffles are sufficiently tall to prevent a substantial amount of oil from sloshing over the baffles during high acceleration vehicle maneuvers.

8. The oil pan of claim 5, wherein the opening in said first baffle is substantially the same size as the opening in said second baffle.

9. An engine comprising:

an engine block including at least one cylinder and a crankshaft;

a crankshaft oil deflector positioned below the crankshaft; a one-piece oil pan connected to the engine block closely adjacent said crankshaft oil deflector, said oil pan having a plurality of vertical baffles dividing the oil pan into four chambers, said baffles having openings to allow limited oil flow between said chambers, wherein one of said chambers acts as an oil pick-up chamber and includes a pick-up tube; and wherein the oil pan is characterized by the absence of a separate horizontal baffle extending over the oil pan.

10. The engine of claim 9, wherein said body is a cast aluminum component and said four chambers include said oil pick-up chamber, a rear chamber and two side chambers.

11. The engine of claim 10, wherein one of said openings is positioned at a base of one of said vertical baffles to communicate said rear chamber with said oil pick-up chamber, and two more of said openings are positioned at a base of another two of said vertical baffles, respectively, to communicate said two side chambers with said oil pick-up chamber.

12. The engine of claim 10, wherein said vertical baffles forming said rear chamber are angled with respect to each other to form a funnel shape to direct oil toward the pick-up chamber.

13. The engine of claim 10, wherein a first of said vertical baffles separates one of said side chambers from the oil pick-up chamber, a second of said vertical baffles separates the other of said side chambers from the oil pick-up chamber, a third of said vertical baffles separates said other of said side chambers from said rear chamber, a fourth of said vertical baffles separates said rear chamber from said oil pick-up chamber, and a fifth of said vertical baffles separates said rear chamber from said one of said side chambers.

14. The engine of claim 13, wherein said first, second and fourth vertical baffles each has an opening formed therein to provide limited fluid communication between respective adjacent chambers.

15. The engine of claim 13, wherein said first, second and fourth vertical baffles are sufficiently tall to prevent a substantial amount of oil from sloshing over the vertical baffles during high acceleration vehicle maneuvers.

16. The engine of claim 13, wherein the opening in said first vertical baffle is substantially the same size as the opening in said second vertical baffle.

17. An oil pan for an engine comprising:

a one-piece cast aluminum body having a floor and side walls;

said body having a plurality of baffles extending vertically from the floor and intersecting each other and the side walls in a manner to form four chambers, and said walls having openings to allow oil flow therethrough;

wherein said four chambers include an oil pick-up chamber, a rear chamber and two side chambers; and wherein one of said openings is positioned at a base of one of said baffles to communicate said rear chamber with said oil pick-up chamber, and two more of said openings are positioned at a base of another two of said baffles, respectively, to communicate said two side chambers with said oil pick-up chamber.

18. The oil pan of claim 17, wherein said baffles forming said rear chamber are angled with respect to the side walls to form a funnel shape to direct oil toward the pick-up chamber.

19. The oil pan of claim 17, wherein a first of said baffles separates one of said side chambers from the oil pick-up chamber, a second of said baffles separates the other of said side chambers from the oil pick-up chamber, a third of said baffles separates said other of said side chambers from said rear chamber, a fourth of said baffles separates said rear chamber from said oil pick-up chamber, and a fifth of said baffles separates said rear chamber from said one of said side chambers.

20. The oil pan of claim 19, wherein said first, second and fourth baffles each has an opening formed therein to provide limited fluid communication between respective adjacent chambers.

* * * * *